US008864091B1

(12) United States Patent
Patriarco

(10) Patent No.: US 8,864,091 B1
(45) Date of Patent: Oct. 21, 2014

(54) ARTICULATING KEYBOARD AND MOUSE PLATFORM SYSTEM

(71) Applicant: Kenneth A. Patriarco, Tampa, FL (US)

(72) Inventor: Kenneth A. Patriarco, Tampa, FL (US)

(73) Assignee: Filco/USA, Inc., Tampa, FL (US)

( * ) Notice: Subject to any disclaimer, the term of this patent is extended or adjusted under 35 U.S.C. 154(b) by 0 days.

(21) Appl. No.: 14/252,176

(22) Filed: Apr. 14, 2014

Related U.S. Application Data

(60) Provisional application No. 61/811,441, filed on Apr. 12, 2013.

(51) Int. Cl.
*A47G 1/10* (2006.01)
*A47B 21/03* (2006.01)

(52) U.S. Cl.
CPC ..... *A47B 21/0314* (2013.01)
USPC ..... 248/316.1; 248/231.71; 108/143; 312/208.1; 312/223.3

(58) Field of Classification Search
USPC ..... 248/310, 316.1, 316.8, 298.1, 227.2, 248/231.71; 108/143, 50.01, 50.02, 97, 98; 312/208.1, 223.3
See application file for complete search history.

(56) References Cited

U.S. PATENT DOCUMENTS

| | | | | | |
|---|---|---|---|---|---|
| 1,619,409 | A * | 3/1927 | Ferguson | 108/98 |
| 1,741,581 | A * | 12/1929 | Nordin | 108/97 |
| 3,181,485 | A * | 5/1965 | Dotson et al. | 108/97 |
| 5,277,392 | A * | 1/1994 | Rossman et al. | 248/231.71 |
| 5,351,897 | A * | 10/1994 | Martin | 248/118 |
| 5,590,607 | A * | 1/1997 | Howard | 108/98 |
| 5,881,984 | A * | 3/1999 | Lin | 248/284.1 |
| 6,375,132 | B1 * | 4/2002 | Tomlinson | 248/117.6 |
| 6,419,197 | B2 * | 7/2002 | Kochanski et al. | 248/298.1 |
| 6,527,235 | B1 * | 3/2003 | Cotterill | 248/118.3 |
| 6,536,728 | B1 | 3/2003 | Hagglund et al. | |
| 6,938,866 | B2 | 9/2005 | Kirchhoff | |
| 7,086,634 | B1 | 8/2006 | Kirchhoff | |
| 7,113,393 | B2 | 9/2006 | Kirchhoff | |
| 7,575,205 | B2 | 8/2009 | Kirchhoff | |
| 8,511,240 | B1 * | 8/2013 | Strock | 108/98 |
| 8,667,906 | B2 * | 3/2014 | Anglavis | 108/97 |
| 2002/0195533 | A1 * | 12/2002 | Gilberton | 248/316.1 |
| 2003/0042380 | A1 | 3/2003 | Hagglund et al. | |

OTHER PUBLICATIONS

3M. Adjustable Keyboard Tray with Tool-Free Installation Info Sheet. Office Supplies Division Workspace Solutions Business. 2008: 1-2.

(Continued)

*Primary Examiner* — Alfred J Wujciak
(74) *Attorney, Agent, or Firm* — Nilay J. Choksi; Smith & Hopen, P.A.

(57) ABSTRACT

A keyboard/mouse platform system. The system comprises an array of components assembled onto any suitable desk or workstation. The components include a keyboard/mouse tray, a slide rail, a clamp/bracket secured to a proximal end of the slide rail above the slide rail, a post clamp attached to the distal end of the slide rail on the underside of the slide rail, and a vertical support post that is secured within the post clamp and supports the distal end of the slide rail underneath the desk. The system would be assembled, such that the clamp supports the proximal end of the slide rail by gripping the desk, and the support post supports the distal end of the slide rail. Optionally, the system can include a height-adjusting mechanism that connects the keyboard/mouse tray to the slide rail and is capable of elevating or lowering the keyboard/mouse tray.

20 Claims, 10 Drawing Sheets

(56) References Cited

OTHER PUBLICATIONS

3M. Tool-Free Adjustable Keyboard Tray Owner's Manual. 2009: 1-11.
3M. Adjustable Keyboard Tray Info Sheet. Office Supplies Division Workspace Solutions Business. 2007: 1-2.
3M. Adjustable Keyboard Tray Info Sheet AKT150LE. Office Supplies Division Workspace Solutions Business. 2007: 1-2.
3M. Tool-Free Adjustable Keyboard Tray Owner's Manual AKT65LE. 2009: 1-11.
3M. Adjustable Keyboard Tray with Tool-Free Installation Info Sheet AKT65LE. Office Supplies Division Workspace Solutions Business. 2008: 1-2.

* cited by examiner

ARTICULATING KEYBOARD AND MOUSE PLATFORM SYSTEM

CROSS-REFERENCE TO RELATED APPLICATIONS

This nonprovisional application is a continuation of and claims priority to provisional application No. 61/811,441, entitled "Articulating Keyboard & Mouse Platform System", filed Apr. 12, 2013 by the same inventor, the entirety of which is incorporated herein by reference.

BACKGROUND OF THE INVENTION

1. Field of the Invention

This invention relates, generally, to keyboard and mouse frays. More specifically, it relates to an easy-to-install, universal, articulating keyboard and mouse platform system.

2. Brief Description of the Prior Art

Keyboard platforms, trays, and drawers that are installable on top and on the underside of desks are well-known in the art. Many keyboard and mouse trays that are installed underneath a desk can slide in and out from underneath the horizontal top side of a desk or workstation. This "in" position typically is a storage position where the keyboard and mouse tray is confined underneath the top side of the desk and is not extending significantly past the spatial confines of the desk itself. The "out" position typically is the usage position where the keyboard and mouse tray extend past the spatial confines of the desk for usage by a user or operator. Additionally, more recent keyboard and mouse trays, in the "out" usage position, have the ability to be elevated, lowered, and tilted to accommodate for each user's body structure and to provide the most ergonomically effective configuration.

Examples of conventional keyboard and mouse trays include the 3M® AKT150LE, 3M® AKT101LE, U.S. Pat. No. 7,086,634, U.S. Pat. No. 7,113,393, and U.S. Pat. No. 6,536,728, each of which is incorporated herein in its entirety. These embodiments exemplify the conventional art and their abilities to be installed underneath or within a desk or workstation, such that height of relevant portion of the tray and the mouse pad are configurable to the user's needs.

However, each of these devices are highly difficult to assemble and install onto a desk. Typically, this assembly and installation can take approximately 20-40 minutes or longer and may require more than one individual. An array of screws must be used to affix the top of the elongate slide rail/support structure to the bottom of the horizontal top side of the desk. Typically pilot holes must be drilled into the underside of the desk to facilitate drilling of the screws during installation. Thus, in order to install the device, two individuals may even be required—one to stabilize the support structure to the bottom of the desk and one to insert the screws in each aperture and pilot hole. This is a time-consuming and labor-intensive procedure for installing a keyboard and mouse platform.

An example of a keyboard and mouse tray that attempts to alleviate this intensive burden of assembly and installation can be seen in 3M® AKT65LE, or U.S. Pat. No. 7,575,205, which is incorporated herein by reference in its entirety. In this device, rather than affixing the slide rail/support structure to the bottom of the desk using screws, the device utilizes an adhesive (e.g., COMMAND®-brand adhesives) to adhere the top of the slide rail to the underside of the desk. However, several issues can arise with this device, namely that it may not be effective at providing a permanent keyboard and mouse tray/platform. For example, the adhesive may be a temporary solution to providing an easy installation of a keyboard and mouse tray as the adhesive may potentially lose its adhesive properties.

The product (the '205 patent) alleges that the adhesive used therein becomes increasingly effective after initial contact through the first 24 hours. However, over time, as with many conventional adhesives, the adhesive may gradually lose its viscidity, reducing its long-term effectiveness. Thus, even on initial securement of the slide rail/support structure to the desk, the entire device can potentially sag as the adhesive fails to fully and completely secure the two components (slide rail and desk) together. Sagging might elevate the keyboard platform and its planar horizontal stage to an instable and/or oblique level that may not be desired by the user. In a worst case scenario, the apparatus itself may collapse. Thus, the user would not be able to enjoy a fully-customized keyboard and mouse tray and in that case would need to purchase a new adhesive or a new/different keyboard stand after a relatively short period of time. This device incurs a tradeoff between ease of installation (which is improved from the previous devices requiring screws) and stability under the desk (which is worsened from the previous devices requiring screws).

Accordingly, what is needed is an improved keyboard and mouse tray that is easy to assembly and install, while also retaining the ability to be fully stable underneath any desk or workstation, thus providing the user maximum comfort and ergonomic effectiveness. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved keyboard and mouse platform system is now met by a new, useful, and nonobvious invention.

In an embodiment, the current invention is a keyboard and mouse platform system for a desk, where the desk has a surface capable of installation of the platform system thereunder. The platform system includes an elongate slide rail having a proximal end, a distal end, a planar upper surface, and a planar lower surface. The proximal end of the slide rail corresponds to the proximal edge of the desk relative to the user. The upper surface of the slide rail extends along the desk surface. The system further includes a desk clamp attached to the proximal end of the slide rail and spatially positioned substantially in overlying relation to the proximal end of the slide rail. The desk clamp grasps the proximal edge of the desk and is secured to the proximal edge of the desk in order to support the proximal end of the slide rail at the proximal edge of the desk. The system further includes a post clamp attached to the tower surface of the slide rail in proximity to the distal end of the slide rail. The post clamp extends in a downward direction from the slide rail under the slide rail. The post clamp has a substantially hollow interior. The system further includes an elongate support post having an upper end and a lower end. The upper end of the support post is slidably and removably inserted into the interior of the post clamp and extends in a downward direction until it contacts the ground on which the desk is positioned. The support post is extendable so that the support post can be taut between the post clamp and the ground. The system further includes a keyboard and mouse tray, along with a connector apparatus that directly or indirectly connects the slide rail to the keyboard and mouse tray. The system further includes a proximal stopper and a distal stopper for preventing the connector apparatus from falling out of the slide rail proximally or distally, respectively.

Using the foregoing configuration, there optionally may be no physical connection point maintained between the slide rail and the desk surface.

The desk clamp may be structured to grasp the proximal edge of the desk by using a thumbscrew disposed through the desk clamp and the proximal end of the slide rail to place a pressure on the desk surface.

The support post may be extendable via an end screw extension at the lower end of the support post, where the end screw extension would be screw-threaded, for lengthening a height of the post by loosening the end screw extension, and vice versa.

The support post may also be extendable at its upper end via a thumbscrew positioned through the post clamp and contacting the upper end of the support post.

The proximal stopper may be a stopper thumbscrew positioned through the desk clamp and the proximal end of the slide rail.

The distal stopper may be the same as the post clamp.

The connector apparatus may include a height-adjustable component that allows the keyboard and mouse tray to be elevated and depressed according to the needs of the user.

The desk clamp may be a U-shaped member, where the U-shaped member has a lower member positioned in underlying relation to the desk surface and an upper member positioned in overlying relation to the desk surface, in order to effectively grasp the proximal edge of the desk.

The post clamp and support post may be cylindrical in shape for supporting the distal end of the slide rail.

In a separate embodiment, the current invention is a keyboard and mouse platform system for a desk, where the desk has a surface capable of installation of the platform system thereunder. The platform system includes an elongate slide rail having a proximal end, a distal end, a planar upper surface, and a planar lower surface. The proximal end of the slide rail corresponds to the proximal edge of the desk relative to the user. The upper surface of the slide rail extends along the desk surface. The system further includes a desk clamp attached to the proximal end of the slide rail and spatially positioned substantially in overlying relation to the proximal end of the slide rail. The desk clamp grasps the proximal edge of the desk and is secured to the proximal edge of the desk in order to support the proximal end of the slide rail at the proximal edge of the desk. The system further includes an elongate support post having an upper end and a lower end. The upper end of the support post is directly or indirectly coupled to the lower surface of the slide rail and extends in a downward direction until it contacts the ground on which the desk is positioned. The support post is extendable so that the support post can be taut between the post clamp and the ground. The system further includes a keyboard and mouse tray, along with a connector apparatus that directly or indirectly connects the slide rail to the keyboard and mouse tray. The system further includes a proximal stopper and a distal stopper for preventing the connector apparatus from falling out of the slide rail proximally or distally, respectively.

The platform system may further include a post clamp attached to the lower surface of the slide rail in proximity to the distal end of the slide rail. The post clamp extends in a downward direction from the slide rail under the slide rail. The post clamp has a substantially hollow interior. In this case, the upper end of the support post is slidably and removably inserted into the interior of the post clamp. In a further embodiment, the support post may be extendable at its upper end via a thumbscrew positioned through the post clamp and contacting the upper end of the support post. In another embodiment, the distal stopper can be the same as the post clamp.

Using the foregoing configuration, there optionally may be no physical connection point maintained between the slide rail and the desk surface.

The desk clamp may be structured to grasp the proximal edge of the desk by using a thumbscrew disposed through the desk clamp and the proximal end of the slide rail to place a pressure on the desk surface.

The support post may be extendable via an end screw extension at the lower end of the support post, where the end screw extension would be screw-threaded for lengthening a height of the post by loosening the end screw extension, and vice versa.

The proximal stopper may be a stopper thumbscrew positioned through the desk clamp and the proximal end of the slide rail.

In a separate embodiment, the current invention is a keyboard and mouse platform system for a desk, where the desk has a surface capable of installation of the platform system thereunder. The platform system includes an elongate slide rail having a proximal end, a distal end, a planar upper surface, and a planar lower surface. The proximal end of the slide rail corresponds to the proximal edge of the desk relative to the user. The upper surface of the slide rail extends along the desk surface. The system further includes a desk clamp attached to the proximal end of the slide rail and spatially positioned substantially in overlying relation to the proximal end of the slide rail. The desk clamp grasps the proximal edge of the desk by using a thumbscrew disposed through the desk clamp and the proximal end of the slide rail to place a pressure on the desk surface. The desk clamp is secured to the proximal edge of the desk in order to support the proximal end of the slide rail at the proximal edge of the desk. The desk clamp is a U-shaped member, where the U-shaped member has a lower member positioned in underlying relation to the desk surface and an upper member positioned in overlying relation to the desk surface, in order to effectively grasp the proximal edge of the desk. The system further includes a cylindrical post clamp attached to the lower surface of the slide rail in proximity to the distal end of the slide rail. The post clamp extends in a downward direction from the slide rail under the slide rail. The post clamp has a substantially hollow interior. The system further includes a cylindrical elongate support post having an upper end and a lower end. The upper end of the support post is slidably and removably inserted into the interior of the post clamp and extends in a downward direction until it contacts the ground on which the desk is positioned. The support post has a diameter that is smaller than the inner diameter of the post clamp. The support post is extendable via an end screw extension at the lower end of the support post, where the end screw extension would be screw-threaded for lengthening a height of the post by loosening the end screw extension, and vice versa. This is done so that the support post can be taut between the post clamp and the ground. The support post may also be extendable at its upper end via a thumbscrew positioned through the post clamp and contacting the upper end of the support post. The system further includes a keyboard and mouse tray, along with a connector apparatus that directly or indirectly connects the slide rail to the keyboard and mouse tray. The connector apparatus includes a height-adjustable component that allows the keyboard and mouse tray to be elevated and depressed according to the needs of the user. The system further includes a proximal stopper and a distal stopper for preventing the connector apparatus from falling out of the slide rail proximally or distally, respectively. The proximal stopper is a stopper thumbscrew positioned through the desk clamp and the proximal end of the slide rail. The distal stopper may be the same as the post clamp. Using this configuration, there is no physical connection point maintained between the slide rail and the desk surface.

An object of the current invention is to provide a keyboard and mouse platform that can be installed by a user in a minimal number of minutes, preferably under two (2) minutes.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT in the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The term "proximal" is used herein to denote a position spatially closer to a user or operator of the current keyboard and mouse platform system. The term "distal" is used herein to denote a position spatially further from a user or operator of the current keyboard and mouse platform system.

As exemplified collectively in FIGS. 1A-4C, various embodiments of the current invention comprise an articulating keyboard and mouse platform system. The system includes various components a keyboard and mouse tray, a slide rail, a clamp/bracket secured to the proximal end of the slide rail and in overlying relation to the slide rail, and a connector mechanism (optionally height-adjustable) that both connects the keyboard/mouse tray and slide rail to each other and also is capable of elevating or lowering the keyboard and mouse tray. The system further includes a post clamp disposed on the distal end of the slide rail and in underlying relation to the slide rail, and a vertical support post configured to fit within the post clamp and intended to support the distal end of the slide rail underneath a desk or workstation, as the support post extends to the ground on which the desk or workstation rests.

The components of the current invention are assembled such that the proximal end of a slide rail that runs along the lower surface of the top part of the desk is supported on its proximal end by an elongate C-clamp gripping the desk and on its distal end by a vertical support post that extends from the slide rail to the ground on which the desk is positioned. The structure and methodology the foregoing and alternative components of the current invention will become more apparent as this specification continues, particularly through descriptions of the accompanying figures.

Figure 1A:
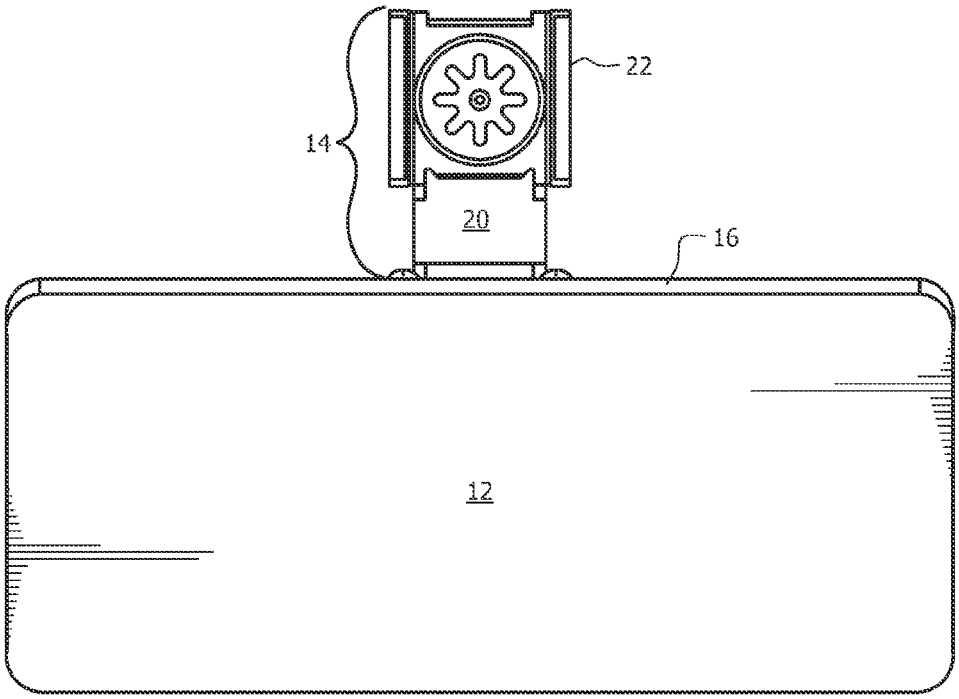
FIG. 1A is a top view of a keyboard and mouse tray and a height-adjusting connector mechanism coupled to one another according to an embodiment of the current invention.
Figure 1B:
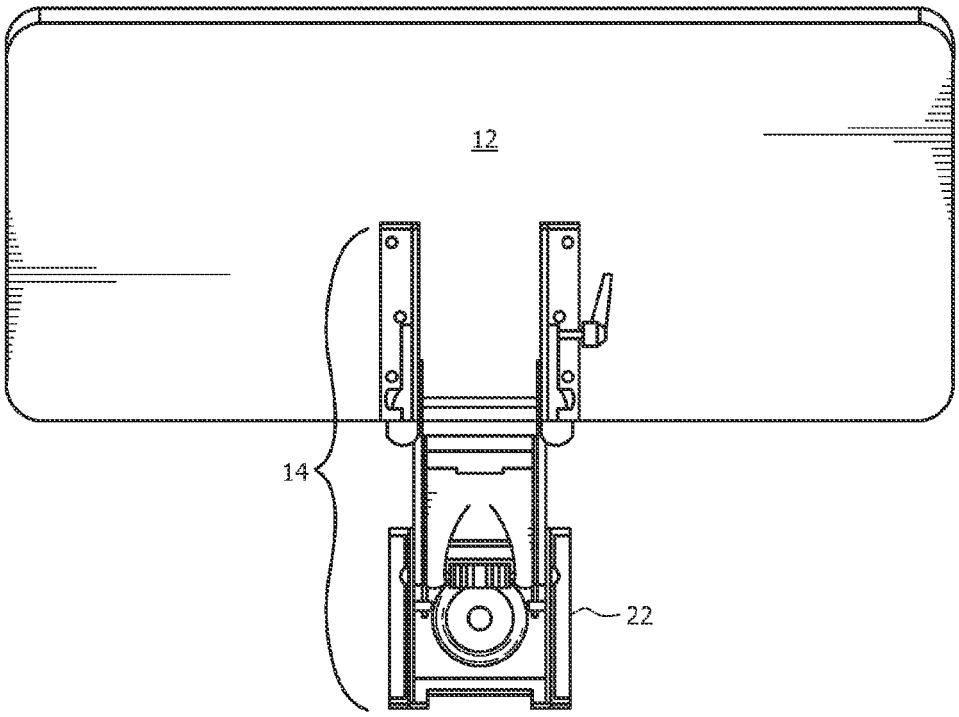
FIG. 1B is a bottom view of a keyboard and mouse tray and a height-adjusting connector mechanism coupled to one another according to an embodiment of the current invention.

FIG. 1A depicts the top of an assembly made up of keyboard and mouse tray 12 and connector mechanism 14. FIG. 1B depicts the bottom of said assembly with keyboard and mouse tray 12 and connector mechanism 14 (e.g., FELLOWES DESIGNER SUITES Premium Keyboard Tray, NEUTRAL POSTURE EASY-A11 Adjustable Keyboard Tray, KENSINGTON Fully Articulating Underdesk Keyboard Drawer, etc.). Keyboard and mouse tray 12 is a generally quadrangle-shaped, flat structure that has a top generally planar surface and a bottom generally planar surface, where the top surface and bottom surface are interconnected. A view of the planar top surface of keyboard and mouse tray 12 can be seen in FIG. 1A, and a view of the planar bottom surface of keyboard and mouse tray 12 can be seen in FIG. 1B. Keyboard and mouse tray 12 and connector mechanism 14 can be seen from the side in FIG. 1C. As shown, backstop 16 can be disposed along a distal edge of keyboard and mouse tray 12 to keep from a keyboard or mouse accidentally falling or slipping off of that distal edge of keyboard and mouse tray 12. It is contemplated that backstop 16 can be disposed along other edges of keyboard and mouse tray 12, as desired, for the same purpose of preventing a keyboard or mouse from falling or slipping off that particular edge protected by backstop 16.

Figure 1C:
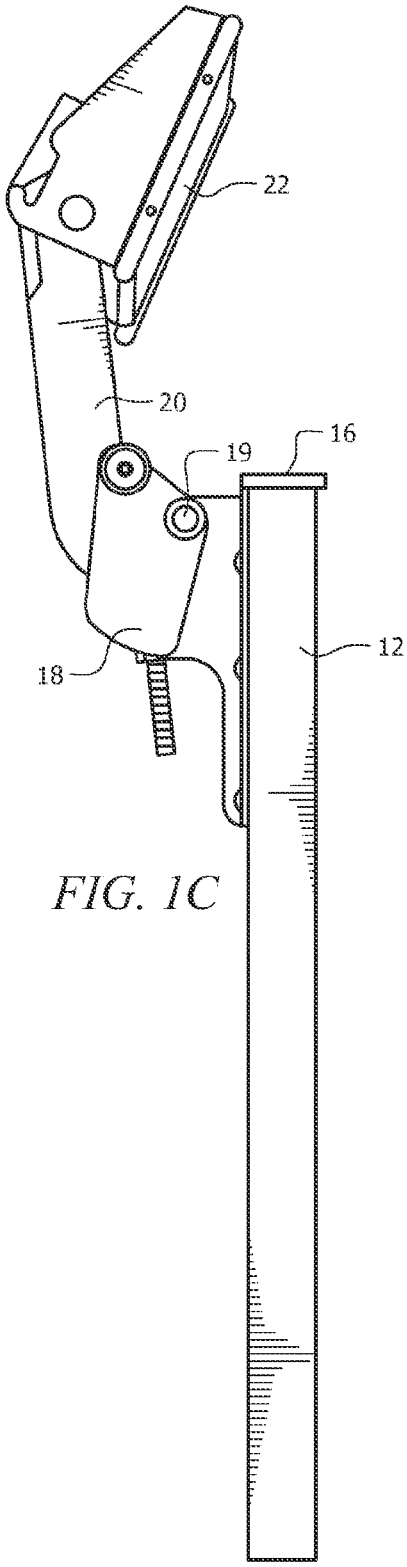
FIG. 1C is a side view of a keyboard and mouse tray and a height-adjusting connector mechanism coupled to one another according to an embodiment of the current invention.

As can be seen in each of FIGS. 1A-1C, connector mechanism or apparatus 14 typically is attached to keyboard and mouse tray 12 closest to the distal edge of keyboard and mouse tray 12 along the planar bottom surface of keyboard and mouse tray 12. This is done so that keyboard and mouse tray can fit easily underneath the desk and also to provide comfort to the user whose legs would typically be directly underneath keyboard and mouse tray 12 when in use. It can be appreciated that connector mechanism or apparatus 14 can be attached or otherwise coupled to keyboard and mouse tray 12 while still retaining the described benefit.

As seen, particularly in FIGS. 1B and 1C, connector mechanism 14 can be pre-assembled with keyboard and mouse tray 12 by bolting mechanism 14 into the planar bottom surface of keyboard and mouse tray 12. However, in other scenarios, such as if mechanism 14 and keyboard and mouse tray 12 are not pre-assembled prior to purchase by the user, it is contemplated that the attachment of mechanism 14 to keyboard and mouse tray 12 can be accomplished by any known means. Regardless of attachment means, this assembly must be very secure so that keyboard and mouse tray 12 cannot become detached or loosened from mechanism 14.

As seen in FIG. 1C, connector mechanism 14 includes platform attachment component 18, height adjuster 20, and slide rail attachment component 22. Platform attachment component 18 is firmly secured to the planar bottom surface of keyboard and mouse tray 12 or is otherwise coupled to keyboard and mouse tray 12, as explained previously.

Height adjuster 20 is secured on its proximal end to platform attachment component 18 and on its distal end to slide rail attachment component 18. Height adjuster 20 extends distally from platform attachment component 18 toward slide rail attachment component 18. Height adjuster 20 permits the elevation and depression of keyboard and mouse tray 12, typically relative to the user and as desired by the user. The current invention contemplates embodiments where height of keyboard and mouse tray 12 is adjustable and also embodiments where height of keyboard and mouse tray 12 is fixed.

Additionally, keyboard and mouse tray 12 can be pivotally coupled 19 to platform attachment component 18, so that keyboard and mouse tray 12 can be tilted upward or downward at a desired angle and locked into place at that angle or tilt.

Figure 2A:
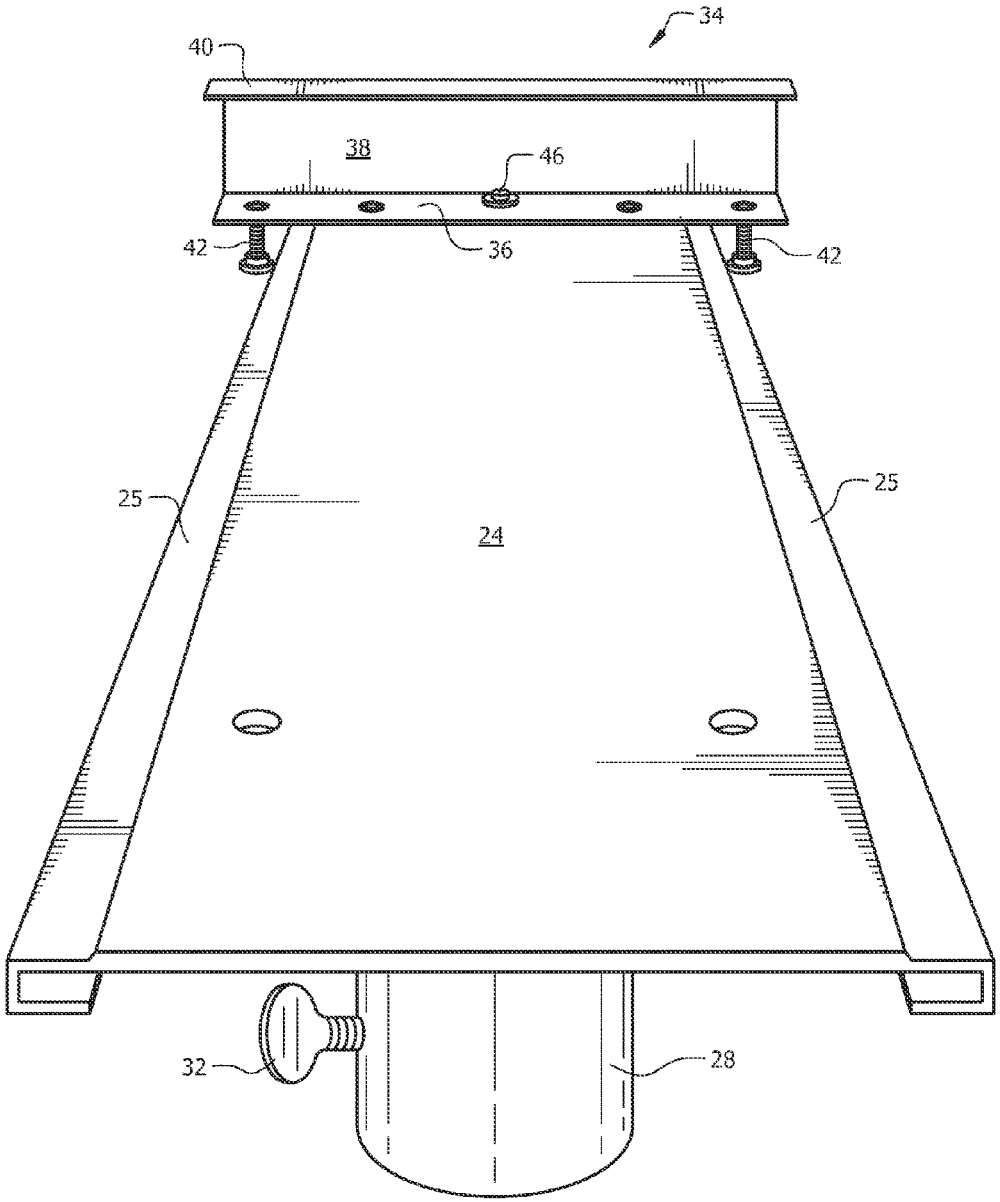
FIG. 2A is an inner end view of a desk clamp/bracket, slide rail, and post clamp, according to an embodiment of the current invention.
Figure 2B:
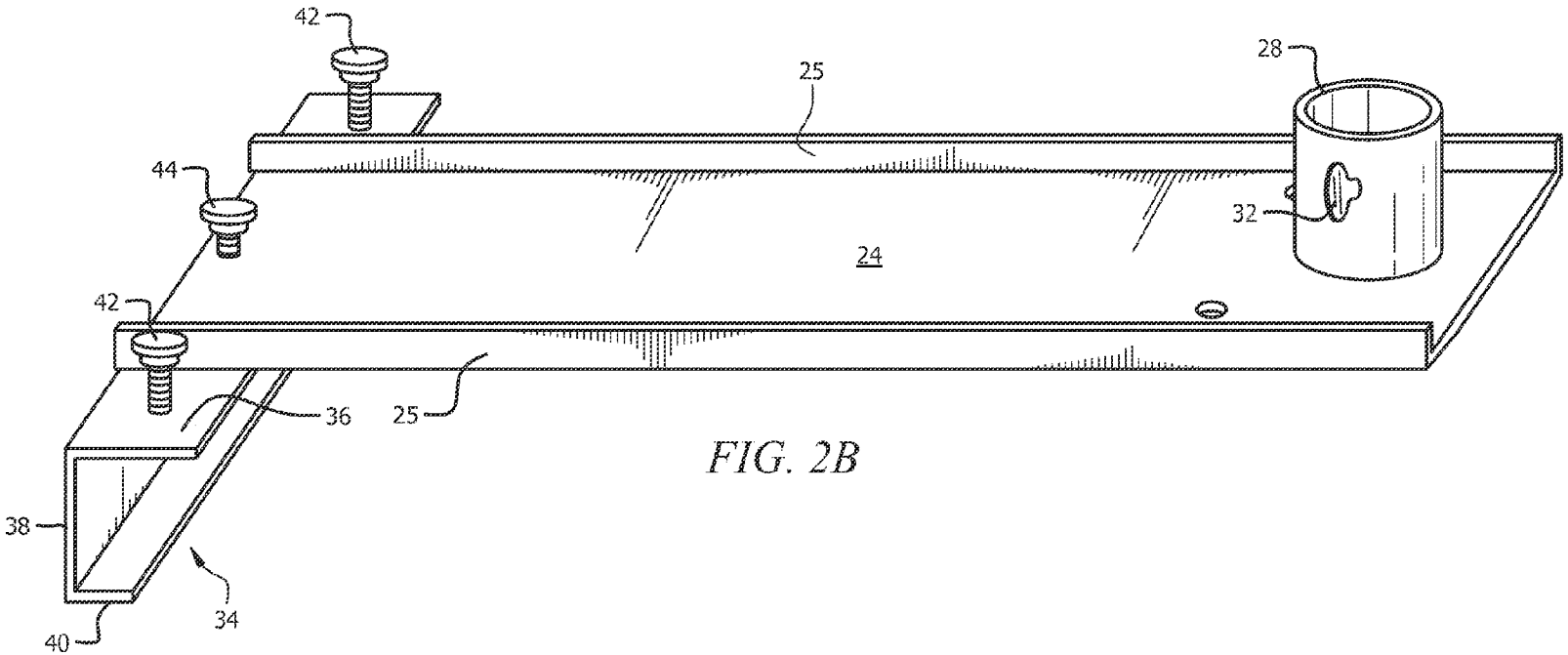
FIG. 2B is a lower perspective side view of a post clamp, and a desk clamp/bracket coupled to a slide rail via thumbscrews, according to an embodiment of the current invention.
Figure 2C:
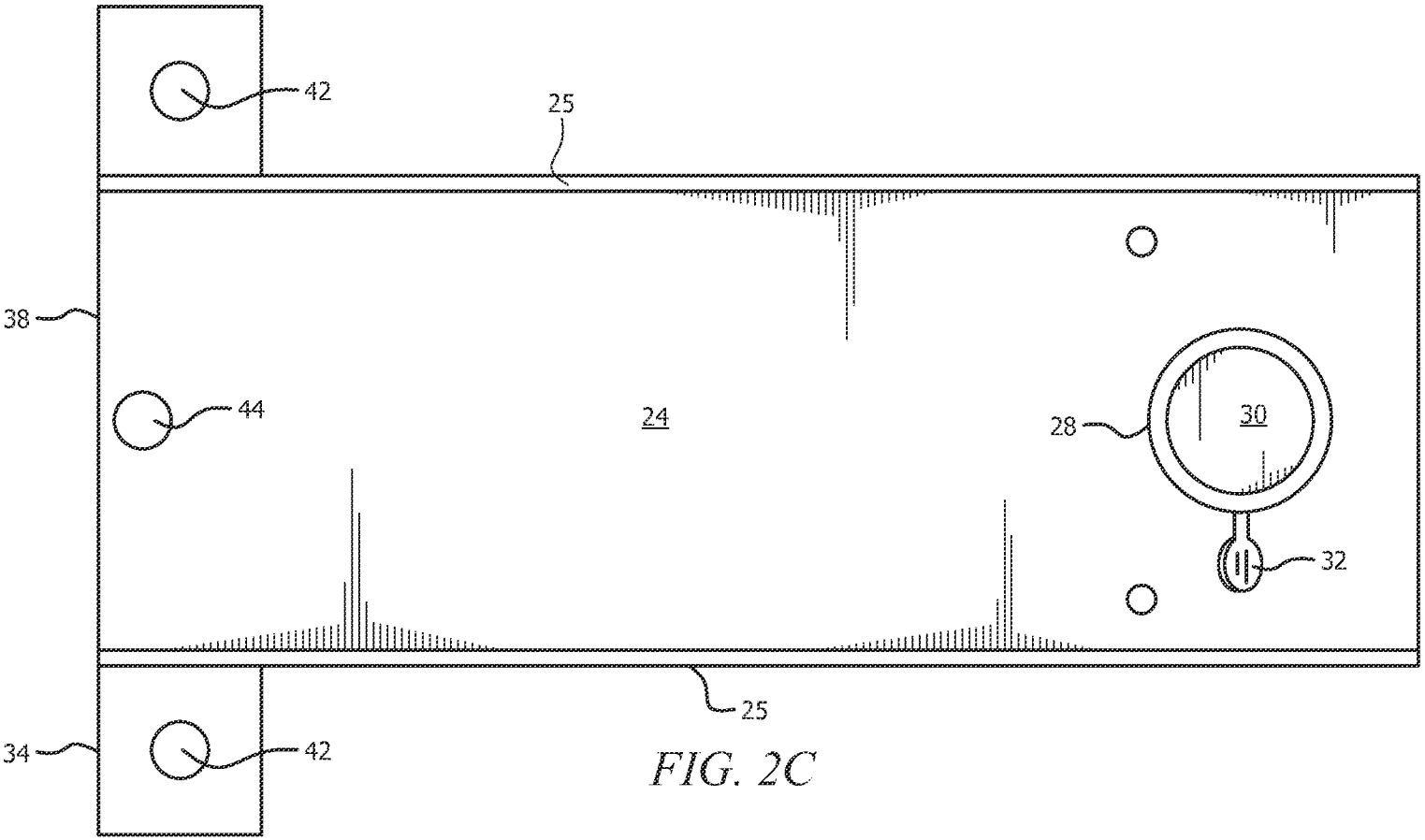
FIG. 2C is a bottom view of a post clamp, and a desk clamp/bracket coupled to a slide rail via thumbscrews, according to an embodiment of the current invention.

FIGS. 2A-2C depict an assembly that includes elongate slide rail 24, clamp or bracket 34 secured or otherwise coupled to the proximal end of slide rail 24, and post clamp 28 coupled near the distal end of slide rail 24. Slide rail 24 is flat, elongate, and has a top surface and bottom surface. Slide rail 24 can be any conventional slide rail suitable for directly or indirectly engaging a keyboard and mouse tray or connector mechanism that can slide in and out from underneath the desk. FIG. 2A depicts hook-shaped members 25 along the longitudinal edges of slide rail 24, where hook-shaped members 25 receive slide rail attachment component 22 of connector mechanism 14.

Still referring to FIGS. 2A-2C, in particular post clamp 28, post clamp 28 is secured (e.g., welded) to the bottom surface of slide rail 24 near the distal end of slide rail 24. When platform system is installed onto a desk or workstation, post clamp 28 extends in a downward direction toward the ground on which the desk or workstation is located. Post clamp 28 may have an open bottom edge or a bottom edge that permits access into hollow interior 30 of post clamp 28. In FIGS. 2A-2C, post clamp 28 appears cylindrical; however, any shape is contemplated, as the shape of post clamp 28 simply needs to match the shape of support post 48. Post clamp 28 includes hollow interior 30 that is suitable for an upper end of support post 48 to snugly fit therewithin.

It can be appreciated that the snug fitting of post clamp 28 around the upper end of support post 48 can be sufficient for securing the upper end of support post 48 within post clamp 28 in order to support the distal end of the platform system, in particular slide rail 24.

Alternatively, an optional tightening mechanism can be utilized to tighten the upper end of support port 48 within post clamp 28. An example of this tightening mechanism can be seen in FIGS. 2A-2C. An aperture is disposed within a sidewall of post clamp 28, and through the aperture extends thumbscrew 32 (e.g., knurled head thumbscrew). Tightening thumbscrew 32 inserts thumbscrew 32 further into hollow interior 30 of post clamp 28, and loosening thumbscrew 32 retracts thumbscrew 32 from within hollow interior 30 of post clamp 28.

Once an upper end of support post 48 is fully inserted into post clamp 28, thumbscrew 32 can be tightened until sufficient force is applied to support post 48 by thumbscrew 32 to further secure support post 48 within post clamp 32.

Though a post clamp is described herein and exemplified in FIGS. 2A-2C, the current invention contemplates any means of receiving a support post or connection to a support post, for example a snap connection, hinged connection, among other known means of direct or indirect connection to the bottom surface of slide rail 24, for supporting the distal end of the platform system, in particular slide rail 24, underneath the desk or workstation, when the platform system is installed thereon.

Further, post clamp 24 can act or be used as a distal stopper apparatus in order to prevent connector mechanism 14 (and thus keyboard and mouse tray 12), specifically slide rail attachment component 22, from sliding distally out of slide rail 24, specifically out of hook-shaped members 25, and falling distally off of slide rail 24. Alternatively, if post clamp 24 is not present (e.g., if support post 48 is coupled directly or otherwise indirectly to the bottom surface of slide rail 24), support post 48 can act or be used as the distal stopper apparatus to prevent connector mechanism 14 (and thus keyboard and mouse tray 12), specifically slide rail attachment component 22, from sliding distally out of slide rail 24, specifically out of hook-shaped members 25, and falling distally off of slide rail 24.

Figure 2D:
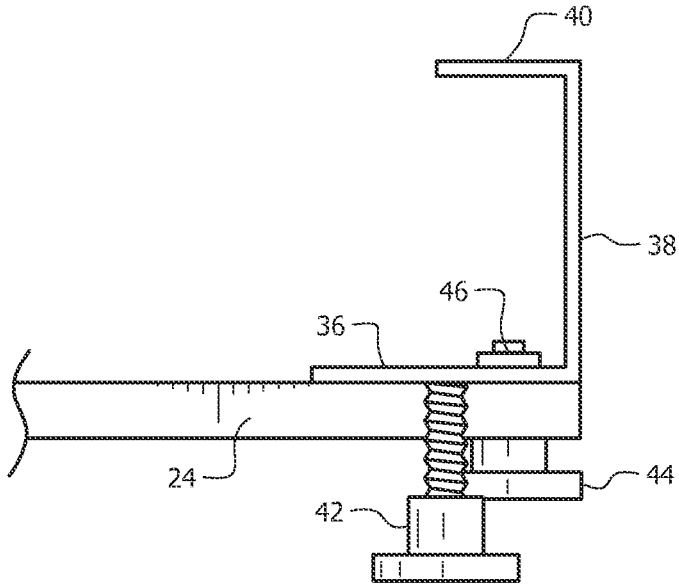
FIG. 2D is a close-up side cross-sectional view of a front desk clamp/bracket with thumbscrews and threaded nut, according to an embodiment of the current invention
Figure 2E:
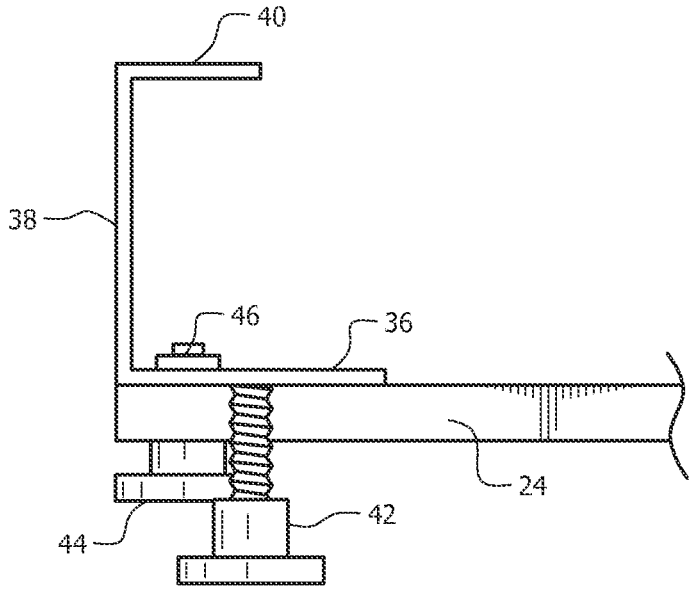
FIG. 2E is an opposite close-up side cross-sectional view of FIG. 2D.

Still referring to FIGS. 2A-2C and further to FIGS. 2D and 2E, bracket 34 can be any apparatus that can be secured to the proximal edge of the desk or workstation with the platform system installed thereon, such that slide rail 24 extends distally underneath the desk or workstation.

In an embodiment seen in FIGS. 2D and 2E, bracket 34 grips the bottom, side, and top of the desk. Here, bracket 34 includes horizontal base plate 36, horizontal flange 40, and vertical transverse plate 38 that vertically connects base plate 36 and flange 40 along corresponding, overlapping, proximal edges of base plate 36 and flange 40. Base plate 36 can be seen to be positioned in overlying relation to the proximal end of slide rail 24, though base plate 36 can be positioned in underlying relation to the proximal end of slide rail 24 as well. It can be seen that traverse plate 38 is substantially vertically aligned with the proximal edge of slide rail 24.

When installed, base plate 36 would be positioned beneath the desk along the bottom surface of the top part of the desk; transverse plate 38 would be positioned on the external vertical extent of the desk; and flange 40 would be positioned above the desk along the top surface of the desk. Thus, clamp 34 would grasp the proximal edge of the desk along a sufficient length of the edge to secure that portion of the platform system to the desk or workstation.

Additionally, a tightening mechanism or apparatus can be utilized to secure bracket 34 (of any type) to the proximal edge of the desk or workstation. Any suitable tightening mechanism can be utilized as long as it is capable of securing bracket 34 to the proximal edge of the desk in order to maintain the position of slide rail 24 underneath the desk.

As an example of a tightening mechanism or apparatus, seen in FIGS. 2D and 2E, two or more apertures are disposed through slide rail 24 and base plate 36. Of the at least two apertures, one is structured to permit the extension of thumbscrew 42 therethrough via the tightening of thumbscrew 42. The other of the at least two apertures is structured to permit the extension of stopper thumbscrew 44 therethrough, as seen in FIGS. 2B-2E. Tightening thumbscrew 42 is used to secure clamp 34 to the desk when installed. Thumbscrew 42 would apply sufficient pressure to the underside of the top part of the desk to allow clamp 34 to remain secure and stationary, in an embodiment, two apertures are present, each for thumbscrew 42 to extend therethrough, on either side of the aperture used by stopper thumbscrew 44, as seen in FIGS. 2D-2E.

As seen in FIGS. 2A and 2D-2E, threaded nut 46 is disposed on the inside of clamp 34 in overlying relation to base plate 38, directly opposite from stopper thumbscrew 44, such that stopper thumbscrew 44 threads directly into threaded nut 46. Stopper thumbscrew 42 is used as a proximal stopper apparatus to prevent connector mechanism 14 (and thus keyboard and mouse tray 12), specifically slide rail attachment component 22, from sliding proximally out of slide rail 24, specifically out of hook-shaped members 25, and falling proximally off of slide rail 24. This will become more apparent as this specification continues.

Figure 3A:
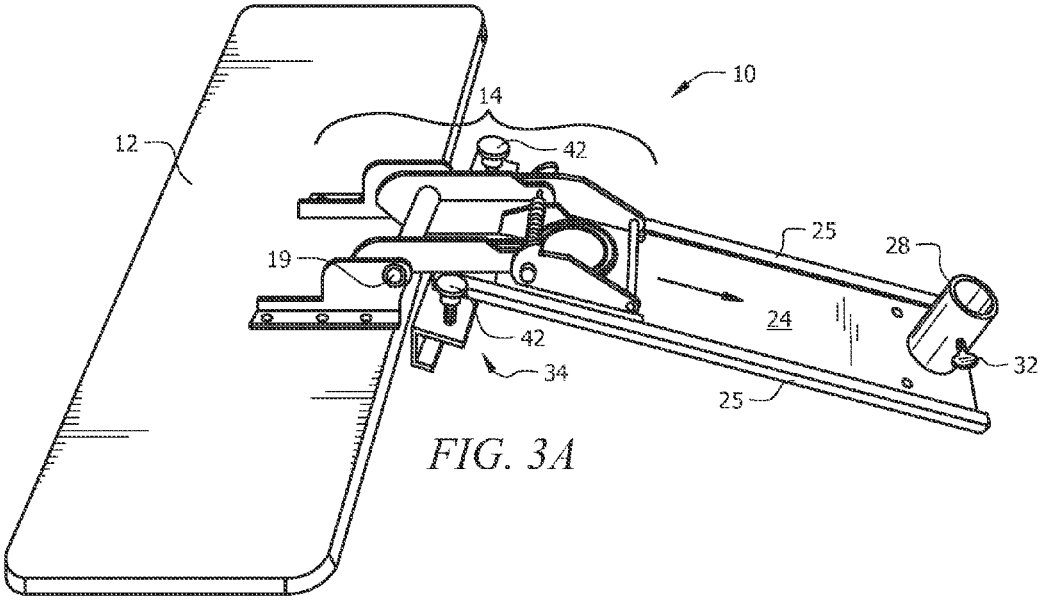
FIG. 3A is a bottom perspective view of a keyboard and mouse tray and height-adjusting connector mechanism assembly coupled to a slide rail and front desk clamp/bracket assembly, according to an embodiment of the current invention.
Figure 3B:
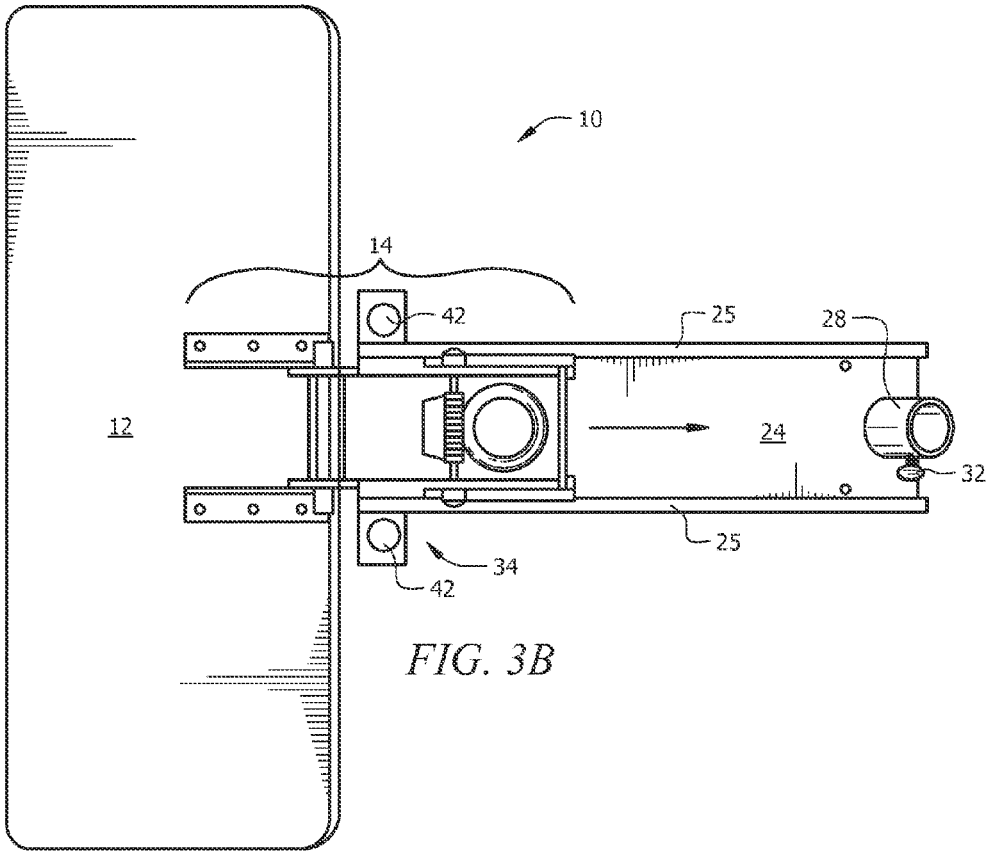
FIG. 3B is a bottom view of a keyboard and mouse tray and height-adjusting connector mechanism assembly coupled to a slide rail and front desk clamp/bracket assembly, according to an embodiment of the current invention.

FIGS. 3A-3B depict an assembled keyboard and mouse platform system, generally denoted by the reference numeral 10, according to an embodiment of the current invention. Platform system 10 includes the assembly of keyboard and mouse tray 12, connector mechanism 14, clamp/bracket 34, slide rail 24, and post clamp 28. As a first component, connector mechanism 14 is secured to keyboard and mouse tray 12. As a second component, post clamp 28 is secured to the distal end of slide rail 24. To assemble these two components together, the lateral edges of slide rail attachment component 22 of connector mechanism 14 slide into hook-shaped members 25 of slide rail 24 that are disposed along each longitudinal edge of slide rail 24. This sliding connection between slide rail 24 and slide rail attachment component 22 of connector mechanism 14 is indicated by the arrow seen in FIGS. 3A and 3B. This allows keyboard and mouse tray 12 to slide along and underneath slide rail 24 as well.

Figure 4A:
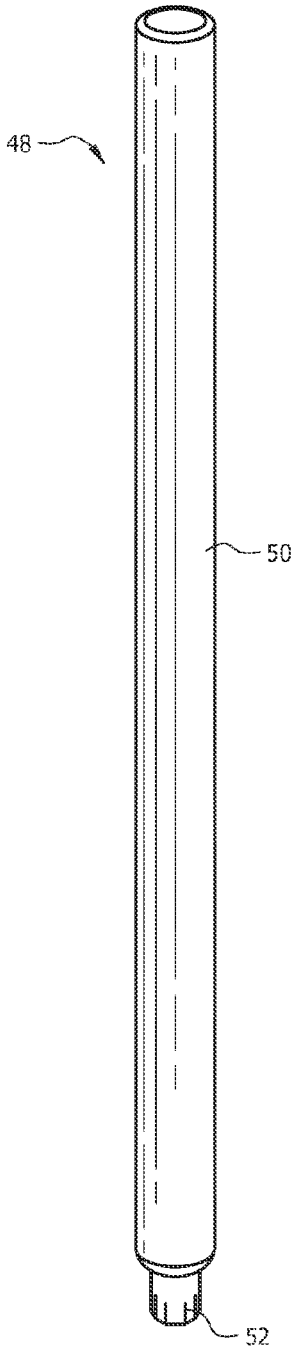
FIG. 4A depicts a vertical support post with end screw extension for height adjustment of said vertical support post according to an embodiment of the current invention.

FIG. 4A depicts elongate support post 48 used in certain embodiments of the current invention. Support post 48 has an upper end and a lower end. The upper end of support post is intended to fit within post clamp 28 or otherwise directly or indirectly coupled to the bottom surface of slide rail 24.

Support post 48 can optionally be extendable (i.e., shortened or lengthened) via any means known in the art, in order to accommodate the height of any desk or workstation. The ultimate goal is for support post 48 to contact the ground in a manner to support the distal end of the platform system, specifically slide rail 24. For example, support post 48 can be telescopically extendable.

Figure 4B:
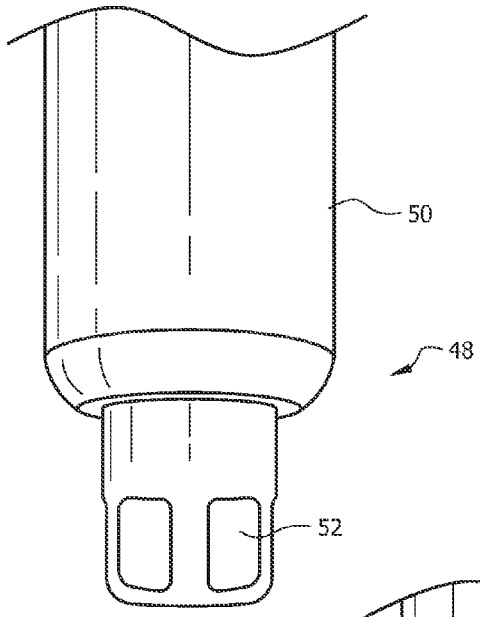
FIG. 4B is a close-up view of an end screw extension at the bottom of a vertical support post, said end screw extension being in a retracted position, according to an embodiment of the current invention.
Figure 4C:
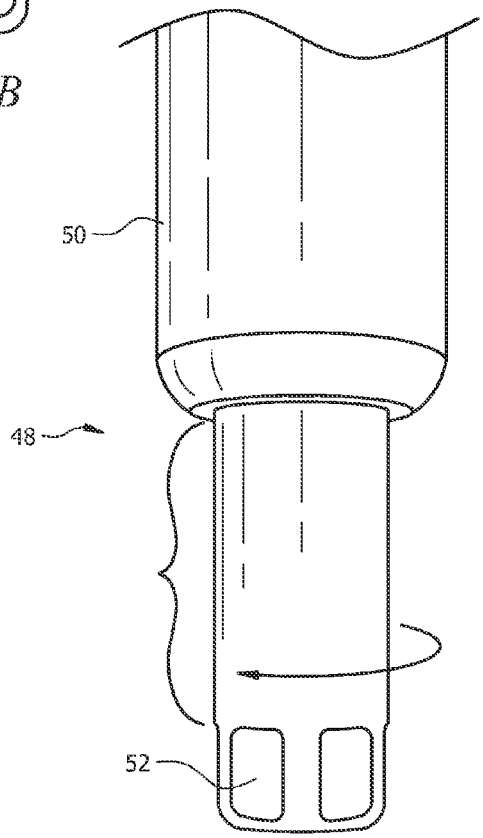
FIG. 4C is a close-up view of the end screw extension of FIG. 4B, said end screw extension being in a fully extended position, wherein the arrow in FIG. 4C show the direction of rotation for extension of the end screw extension.

FIGS. 4B and 4C depict an example of how support post 48 can be extend or be lengthened. Here, support post 48 includes elongate body 50 and has a lower end that includes end screw extension 52, which can be extended. End screw extension 52 is screw-threaded and disposed within the interior of a lower end of elongate body 50. Thus, the lower end of elongate body 50 is hollow to permit the extension and retraction of end screw extension 52. End screw extension 52 can be rotated in a counterclockwise direction or otherwise loosened to lengthen end screw extension 52. Conversely, end screw extension can be rotated in a clockwise direction or otherwise tightened to shorten end screw extension 52.

It is contemplated that the top end of elongate body 50 also can be adjustable via tightening of thumbscrew 32 in post clamp 28 in order to contact different areas along the upper end of elongate body 50. As discussed, other means of adjustment are contemplated as well.

In an embodiment, support post 48 can be structured to fit snugly within post clamp 28 and extends from a distal end of slide rail 24 (i.e., within post clamp 28) to the ground on which the desk is positioned. Thus, support post 48 fully stabilizes slide rail 24 on its distal end. End screw extension 52 permits the ability for support post 48 to become longer or shorter, as necessary, to fit a variety of desk heights. The bottom edge of support post 48 must be able to reach/contact the ground in order to provide full support of the distal end of slide rail 24.

Support post 48 and post clamp 28 can be positioned anywhere along the bottom of slide rail 24, though most likely along the distal half of slide rail 24 to provide support to the distal end of slide rail 24. Thus, because of support post 48, a physical connection point (e.g., screws, adhesives, etc.) may not be needed since a desk clamp grips the proximal edge of the desk to support the proximal end of the slide rail and a support post supports the distal end of the slide rail beneath the desk. Thus, screws do not need to be drilled into the desk, adhesives to not need to be positioned between the slide rail and desk, etc.

In an alternative embodiment, in addition to or in lieu of post clamp 28, support post 48 can be hingedly coupled to slide rail 24 directly or indirectly. For example, support post 48 and slide rail 24 can be pre-assembled, such that support post 48 is coupled to slide rail 24 and extends parallel to the longitudinal extent of slide rail 24. Thus, during installation, clamp 34 is secured to the proximal edge of the desk, and slide rail 24 is disposed along the underside of the desk. Support post 48 can then be pivoted to extend perpendicular to the longitudinal extent of slide rail 24 and subsequently extended to reach and contact the ground to support to the distal end of slide rail 24. Alternatively, it is not always necessary for support post 48 to have a length from slide rail 24 to the ground on which the desk or workstation is positioned. Support post 48, for example, can be coupled to a frame or bracket that is connected to the bottom surface of slide rail 24, and once support post 48 and associated frame or bracket are pivoted perpendicular to the longitudinal extent of slide rail 24, support post 48 can be extended to contact the ground.

EXAMPLE

Figure 5:
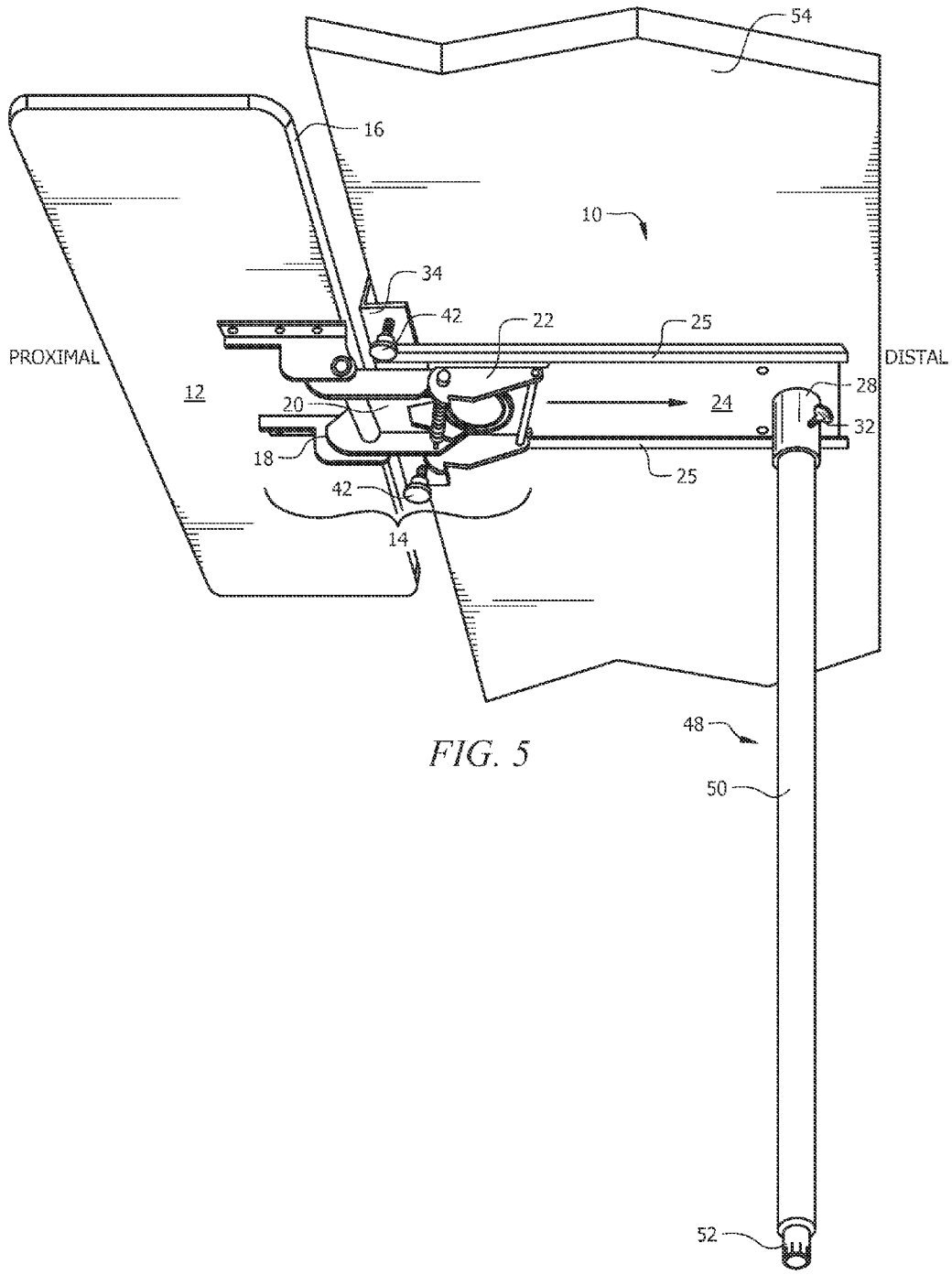
FIG. 5 is bottom perspective view of an embodiment of the current invention installed onto a desk or workstation.
Figure 6:
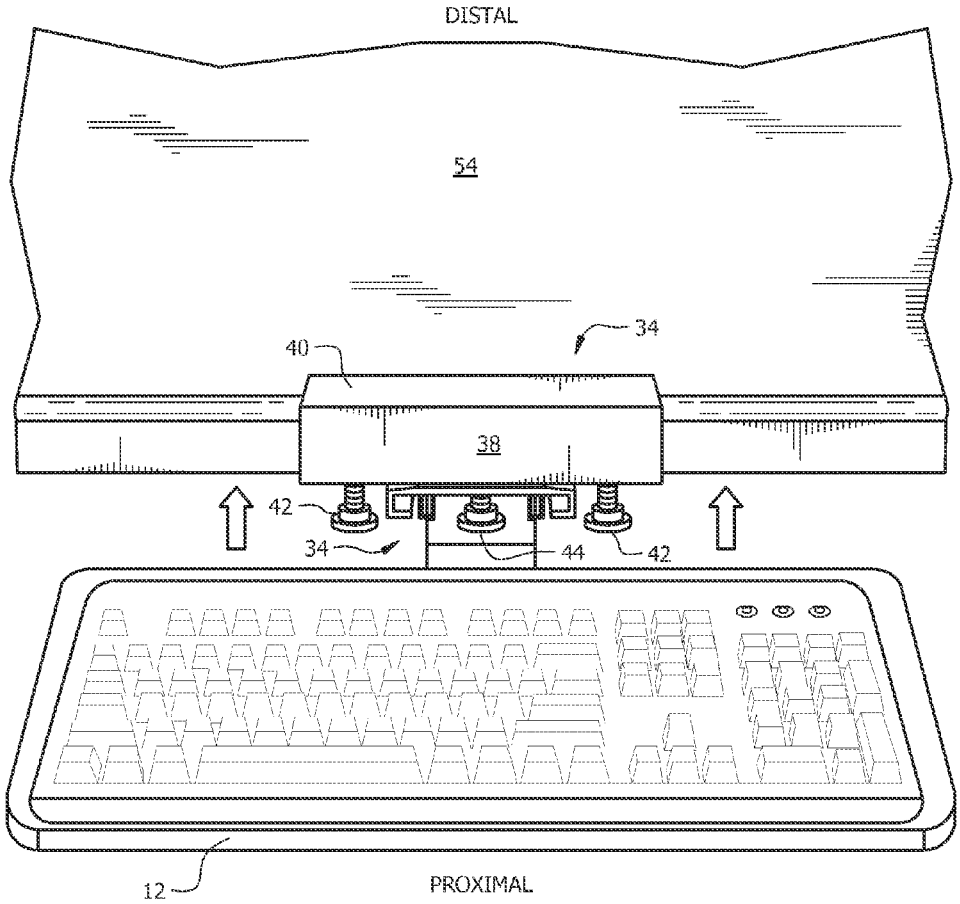
FIG. 6 is a front view of a height-adjusting connector mechanism upon installation of an embodiment of the current invention onto a desk or work station.

FIGS. 5-6 depict keyboard and mouse platform system 10 installed onto desk or workstation 54, according to an embodiment of the current invention. FIG. 5 shows connector mechanism 14 at the proximal end of slide rail 24 and support post 48 in proximity to the distal end of slide rail 24. Thumbscrews 42 are used to secure connector mechanism 14 to the bottom of desk 54.

The lateral edges of slide rail attachment component 22 slide within hook-shaped members 25 along slide rail 24 underneath desk 54, thus allowing keyboard and mouse tray to be positioned underneath desk 54, for example when not in use. Stopper thumbscrew 44 (not seen in this figure) is used as a proximal stopper apparatus to prevent connector mechanism 14 (and thus keyboard and mouse tray 12), specifically slide rail attachment component 22, from sliding proximally out of slide rail 24, specifically out of hook-shaped members 25, and falling proximally off of slide rail 24.

FIG. 5 further shows how the top of support post 48 fits snugly within interior 30 of post clamp 28 positioned in proximity to the distal end of slide rail 24. Thumbscrew 32 can be used to secure the vertical position of support post 48 within post clamp 28. The bottom of support post 48 is stabilized on the ground via its elongate body 50 connected to end screw extension 52. End screw extension 52 can be threaded to shorten or lengthen the overall vertical length of support post 48, such that support post 48 can accommodate different heights of desks or workstations.

Here, post clamp 24 is used as a distal stopper apparatus in order to prevent connector mechanism 14 (and thus keyboard and mouse tray 12), specifically slide rail attachment component 22, from sliding distally out of slide rail 24, specifically out of hook-shaped members 25, and falling distally off of slide rail 24.

FIG. 5 also is a view of connector mechanism 14 underneath desk 54 as secured to the bottom of desk 54. As also seen in FIG. 6, thumbscrews 42 can be tightened to place more pressure on the bottom of desk 54, thus facilitating the stabilization of connector mechanism 14 beneath desk 54 and of keyboard and mouse tray 12. FIG. 5 also shows the sliding connection between connector mechanism 14 and slide rail 24 as indicated by the arrows shown therein. As discussed, the lateral edges of connector mechanism 14 slide within the hook-shaped members of slide rail 24, such that they are coupled to one another as mechanism 14 can slide from beneath desk 54 toward the user, and vice versa.

FIG. 6 shows clamp 34 as installed on desk 54. FIG. 6 is a front view showing transverse plate 38 positioned across the vertical portion of the top part of desk 54. Further, flange 40 is positioned above desk 54 along the top surface of the desk 54. Upon tightening, thumbscrews 42 are used to secure clamp 34 to desk 54. Stopper thumbscrew 42 is positioned and used to prevent connector mechanism 14 from exiting the proximal edge of slide rail 24.

Optionally, keyboard and mouse tray 12 can be rotated, tilted, angled, and elevated via connector mechanism 14. Any known means of connector mechanism 14 can be used, as the manipulability of keyboard and mouse tray 12 is an enhanced benefit of certain embodiments of the current invention.

GLOSSARY OF CLAIM TERMS

Connector apparatus: This term is used herein to refer to any component that connects or indirectly couples the keyboard and mouse tray to the slide rail. The connector apparatus can be fixed, include components for sliding along the slide rail, include components for angling, tilting, and adjusting the height of the keyboard and mouse tray, etc.

Desk clamp: This term is used herein to refer to a brace, clasp, or bracket that is secured to a proximal edge of the desk in order to support the proximal end of the slide rail. Thus, a desk clamp can be a separate component from the slide rail or can be integral with the slide rail.

Directly or indirectly coupled: This term is used herein to refer to a structural connection between two components, where the two components are connected directly to one another or indirectly via a third component.

Distal stopper: This term is used herein to refer to any structure that prevents the connector mechanism (and thus the keyboard and mouse tray), specifically the slide rail attachment component, from sliding distally out of the slide rail, specifically out of the hook-shaped members, and falling distally off of the slide rail. As an example, the distal stopper can be the same as the post clamp or support post when the platform system is installed onto the desk.

Distal: This term is used herein to refer to a position of a component spatially further from a user or operator of the current keyboard and mouse platform system.

End screw extension: This term is used herein to refer to a screw-threaded component that is disposed within the interior of a lower end of the support post. The end screw extension can be tightened and loosened into and out of the lower end of the support post.

Grasp: This term is used herein to refer to a component gripping, clasping, holding or otherwise being secured to another component.

Height-adjustable component: This term is used herein to refer to a part of a connector apparatus that permits the keyboard and mouse tray to be elevated and depressed according to the needs or user of the platform system.

Keyboard and mouse tray: This term is used herein to refer to a generally flat component for supporting a keyboard and/or mouse of a computer system.

Physical connection point: This term is used herein to refer to a typically mechanical or structural link between two components. Examples of physical connection points include screws drilled through a slide rail into a desk, adhesives that adhere a slide rail to a desk, etc. With the current invention, a physical connection point may not be needed since a desk clamp grips the proximal edge of the desk to support the proximal end of the slide rail and a support post supports the distal end of the slide rail beneath the desk. Thus, screws do not need to be drilled into the desk, adhesives to not need to be positioned between the slide rail and desk, etc.

Post clamp: This term is used herein to refer to any component or apparatus that directly or indirectly couples a support post to a bottom/lower surface of a slide rail in proximity to the distal end of the slide rail.

Proximal stopper: This term is used herein to refer to any structure that prevents the connector mechanism (and thus the keyboard and mouse tray), specifically the slide rail attachment component, from sliding proximally out of the slide rail, specifically out of the hook-shaped members, and falling proximally off of the slide rail. As an example, the proximal stopper can be the stopper thumbscrew, as described herein.

Proximal: This term is used herein to refer to a position of a component spatially closer to a user or operator of the current keyboard and mouse platform system.

Slide rail: This term is used herein to refer to a substantially flat component that extends underneath the desk from a proximal edge of the desk distally toward the distal edge of the desk. The slide rail provides a structure along which a connector apparatus (and thus keyboard and mouse tray) can slide or travel when not in use.

Stopper thumbscrew: This term is used herein to refer to a thumbscrew, typically coupled with a threaded nut, for preventing a connector apparatus from falling out of a proximal end of a slide rail.

Substantially hollow interior: This term is used herein to refer to the characteristic of a component having an empty space or cavity therein for fitting another component, wherein any structures present within the empty space or cavity do not hinder reception of the other component. For example, a post clamp can fit the top/upper end of a support post therewithin. The presence of a tightening thumbscrew, for example, would not hinder reception of the upper end of the support post within the post clamp.

Substantially in overlying relation: This term is used herein to refer to a majority or all of a component being positioned above another component. For example, as discussed previously, if the desk damp includes a base plate, transverse plate, and flange, the base plate can be positioned in overlying relation to the proximal end of the slide rail, though the base plate can be positioned in underlying relation to the proximal end of the slide rail as well. The end benefit of the desk clamp being secured to the proximal edge of the desk and supporting the proximal end of the slide rail remains the same.

Support post: This term is used herein to refer to an elongate rod, crutch, dowel, pole or plank that supports the distal end of the slide rail underneath the desk.

Taut: This term is used herein to refer to a support post being tight between the slide rail and the ground on which the desk is positioned in order to properly support the distal end of the slide rail underneath the desk.

Thumbscrew: This term is used herein to refer to a screw that can be tightened, loosened, or otherwise engaged by a human hand.

U-shaped member: This term is used herein to refer to a structure shaped substantially like the letter "U" (typically a sideways "U") for gripping the proximal edge of a desk.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A keyboard and mouse platform system for a desk, said desk having a desk surface capable of installation of said keyboard and mouse platform system thereunder, comprising:

an elongate slide rail having a proximal end, a distal end, a planar upper surface, and a planar lower surface, said proximal end corresponding to a proximal edge of said desk relative to a user, said planar upper surface extending along said desk surface of said desk;

a desk clamp attached to said proximal end of said slide rail and spatially positioned substantially in overlying relation to said proximal end of said slide rail, said desk clamp structured to grasp said proximal edge of said desk and be secured to said proximal edge of said desk in order to support said proximal end of said slide rail at said proximal edge of said desk;

a post clamp attached to said lower surface of said slide rail, said post clamp positioned in proximity to said distal end of said slide rail, said post clamp extending in a downward direction from said slide rail in underlying relation to said lower surface of said slide rail, said post clamp having a substantially hollow interior;

an elongate support post having an upper end and a lower end, said upper end of said elongate support post slidably and removably disposed within said substantially hollow interior of said post clamp, said elongate support post extending from within said post clamp beneath said lower surface of said slide rail to a ground on which said desk is positioned, said support post being extendable so that said support post is taut between said post clamp and said ground;

a connector apparatus slidable coupled to said slide rail;

a keyboard and mouse tray secured to said connector apparatus;

a proximal stopper disposed in proximity to said proximal end of said slide rail to prevent said connector apparatus and said keyboard and mouse tray from sliding proximally off of said proximal end of said slide rail; and a distal stopper disposed in proximity to said distal end of said slide rail to prevent said connector apparatus and said keyboard and mouse tray from sliding distally off of said distal end of said slide rail.

2. A keyboard and mouse platform system as in claim 1, wherein no physical connection point is maintained between said slide rail and said desk surface of said desk.

3. A keyboard and mouse platform system as in claim 1, further comprising:

said desk clamp structured to grasp said proximal edge of said desk and be secured to said proximal edge of said desk by using a thumbscrew disposed through said desk clamp and said proximal end of said slide rail to place a pressure on said desk surface.

4. A keyboard and mouse platform system as in claim 1, further comprising:

said elongate support post being extendable via an end screw extension at said lower end of said elongate support post, said end screw extension being screw-threaded for lengthening a height of said elongate support post by loosening said end screw extension, said end screw extension being screw-threaded further for shortening said height of said elongate support post by tightening said end screw extension.

5. A keyboard and mouse platform system as in claim 1, further comprising:

said elongate support post being extendable via a thumbscrew positioned through said post clamp and contacting said upper end of said elongate support post.

6. A keyboard and mouse platform system as in claim 1, further comprising:

said proximal stopper being a stopper thumbscrew positioned through said desk clamp and said proximal end of said slide rail.

7. A keyboard and mouse platform system as in claim 1, further comprising:

said distal stopper being the same as said post clamp.

8. A keyboard and mouse platform system as in claim 1, further comprising:

said connector apparatus having a height-adjustable component that allows said keyboard and mouse tray to be elevated and depressed.

9. A keyboard and mouse platform system as in claim 1, further comprising:

said desk clamp being a U-shaped member substantially in overlying relation to said proximal end of slide rail, said U-shaped member including a lower member positioned in underlying relation to said desk surface, said U-shaped member further including an upper member positioned in overlying relation to said desk surface.

10. A keyboard and mouse platform system as in claim 1, further comprising:

said post clamp and said elongate support post being cylindrical in shape for supporting said distal end of said slide rail.

11. A keyboard and mouse platform system for a desk, said desk having a desk surface capable of installation of said keyboard and mouse platform system thereunder, comprising:

an elongate slide rail having a proximal end, a distal end, a planar upper surface, and a planar lower surface, said proximal end corresponding to a proximal edge of a desk relative to a user, said planar upper surface extending along said desk surface of said desk;

a desk clamp attached to said proximal end of said slide rail and spatially positioned substantially in overlying relation to said proximal end of said slide rail, said desk clamp structured to grasp said proximal edge of said desk and be secured to said proximal edge of said desk in order to support said proximal end of said slide rail at said proximal edge of said desk;

an elongate support post having an upper end and a lower end, said upper end of said elongated support post is adapted to be coupled to said lower surface of said slide rail, said elongate support post extending to a ground on which said desk is positioned such that said lower end of said elongate support post contacts said ground, said support post being extendable so that said support post is taut between said ground and said lower surface of said slide rail;

a connector apparatus slidable coupled to said slide rail;

a keyboard and mouse tray secured to said connector apparatus;

a proximal stopper disposed in proximity to said proximal end of said slide rail to prevent said connector apparatus and said keyboard and mouse tray from sliding proximally off of said proximal end of said slide rail; and a distal stopper disposed in proximity to said distal end of said slide rail to prevent said connector apparatus and said keyboard and mouse tray from sliding distally off of said distal end of said slide rail.

12. A keyboard and mouse platform system as in claim 11, further comprising:

a post clamp attached to said lower surface of said slide rail, said post clamp positioned in proximity to said distal end of said slide rail, said post clamp extending in a downward direction from said slide rail in underlying relation to said lower surface of said slide rail, said post clamp having a substantially hollow interior, said upper end of said elongate support post slidably and removably disposed within said substantially hollow interior of said post clamp.

13. A keyboard and mouse platform system as in claim 12, further comprising:

said elongate support post being extendable via a thumbscrew positioned through said post clamp and contacting said upper end of said elongate support post.

14. A keyboard and mouse platform system as in claim 12, further comprising:

said distal stopper being the same as said post clamp.

15. A keyboard and mouse platform system as in claim 11, wherein no physical connection point is maintained between said slide rail and said desk surface of said desk.

16. A keyboard and mouse platform system as in claim 11, further comprising:

said desk clamp structured to grasp said proximal edge of said desk and be secured to said proximal edge of said desk by using a thumbscrew disposed through said desk clamp and said proximal end of said slide rail to place a pressure on said desk surface.

17. A keyboard and mouse platform system as in claim 11, further comprising:

said elongate support post being extendable via an end screw extension at said lower end of said elongate support post, said end screw extension being screw-threaded for lengthening a height of said elongate support post by loosening said end screw extension, said end screw extension being screw-threaded further for shortening said height of said elongate support post by tightening said end screw extension.

18. A keyboard and mouse platform system as in claim 11, further comprising:

said proximal stopper being a stopper thumbscrew positioned through said desk clamp and said proximal end of said slide rail.

19. A keyboard and mouse platform system as in claim 11, further comprising:

said desk clamp being a U-shaped member substantially in overlying relation to said proximal end of slide rail, said U-shaped member including a lower member positioned in underlying relation to said desk surface, said U-shaped member further including an upper member positioned in overlying relation to said desk surface.

20. A keyboard and mouse platform system for a desk, said desk having a desk surface capable of installation of said keyboard and mouse platform system thereunder, comprising:

an elongate slide rail having a proximal end, a distal end, a planar upper surface, and a planar lower surface, said proximal end corresponding to a proximal edge of a desk relative to a user, said planar upper surface extending along said desk surface of said desk;

a desk clamp attached to said proximal end of said slide rail and spatially positioned substantially in overlying relation to said proximal end of said slide rail, said desk clamp structured to grasp said proximal edge of said desk and be secured to said proximal edge of said desk by using a thumbscrew disposed through said desk clamp and said proximal end of said slide rail to place a pressure on said desk surface in order to support said proximal end of said slide rail at said proximal edge of said desk, said desk clamp being a U-shaped member that includes a lower member positioned in underlying relation to said desk surface, said U-shaped member further including an upper member positions in overlying relation to said desk surface;

a cylindrical post clamp attached to said lower surface of said slide rail, said post clamp positioned in proximity to said distal end of said slide rail, said post clamp extending in a downward direction from said slide rail in underlying relation to said lower surface of said slide rail, said post clamp having a substantially hollow interior, said post clamp being a distal stopper to prevent;

an cylindrical elongate support post having an upper end and a lower end, said upper end of said elongate support post slidably and removably disposed within said substantially hollow interior of said post clamp, said elongate support post extending from within said post clamp beneath said lower surface of said slide rail to a ground on which said desk is positioned, said elongate support post having a diameter that is smaller than an inner diameter of said post clamp so that said elongate support post snugly fits within said post clamp, said support post being extendable so that said support post is taut between said post clamp and said ground, said elongate support post being extendable via an end screw extension at said lower end of said elongate support post, said end screw extension being screw-threaded for lengthening a height of said elongate support post by loosening said end screw extension, said end screw extension being screw-threaded further for shortening said height of said elongate support post by tightening said end screw extension, said elongate support post being secured via a thumbscrew positioned through said post clamp and contacting said upper end of said elongate support post;

said connector apparatus slidable coupled to said slide rail, said connector apparatus having a height-adjustable component that allows said keyboard and mouse tray to be elevated and depressed;

a keyboard and mouse tray secured to said connector apparatus; and a proximal stopper disposed in proximity to said proximal end of said slide rail to prevent said connector apparatus and said keyboard and mouse tray from sliding proximally off of said proximal end of said slide rail, said proximal stopper being a stopper thumbscrew positioned through said desk clamp and said proximal end of said slide rails, said connector apparatus and said keyboard and mouse tray from sliding distally off of said distal end of said slide rail;

wherein no physical connection point is maintained between said slide rail and said desk surface of said desk.

* * * * *